US006155750A

United States Patent [19]

Wu et al.

[11] Patent Number: 6,155,750

[45] Date of Patent: Dec. 5, 2000

[54] TRENCH SHIELD HAVING WHEELS SIMULTANEOUSLY PROVIDED FOR PROTECTION AND ROLLING PURPOSES

[75] Inventors: Shih-Hsiung Wu; Chen-Chung Lin; Cheng-Yang Hsu, all of Taipei, Taiwan

[73] Assignee: Institute of Occupational Safety and Health, Council of Labor Affairs, Taipei, Taiwan

[21] Appl. No.: 09/290,870

[22] Filed: Apr. 14, 1999

[51] Int. Cl.[7] ..... E02D 17/08

[52] U.S. Cl. ..... 405/283; 405/272; 405/282

[58] Field of Search ..... 405/283, 282, 405/272, 157

[56] References Cited

U.S. PATENT DOCUMENTS 3,710,583 1/1973 Blackwell ..... 405/283
3,820,345 6/1974 Brecht ..... 405/283
5,306,103 4/1994 Spencer ..... 405/282
5,865,567 2/1999 Wilkinson ..... 405/283

*Primary Examiner*—Eileen D. Lillis
*Assistant Examiner*—Sunil Singh
*Attorney, Agent, or Firm*—Dougherty & Troxell

[57] ABSTRACT

A trench shield includes: a pair of shielding wheels rotatably mounted on a pair of retaining plates; a plurality of brace members passing through the two retaining plates for retaining the two shielding wheels, each shielding wheel formed as a protective circular panel for shielding a side wall of a trench excavation for preventing collapse of the trench walls; and two control devices each provided for locking or unlocking each shielding wheel on each retaining plate; whereby upon unlocking of the wheels from the retaining plates and upon rolling of the wheels in the trench, the trench shield will be forwardly moved conveniently and smoothly.

16 Claims, 5 Drawing Sheets

TRENCH SHIELD HAVING WHEELS SIMULTANEOUSLY PROVIDED FOR PROTECTION AND ROLLING PURPOSES

BACKGROUND OF THE INVENTION

Many conventional trench shields had been disclosed for protecting side walls of a trench excavation against collapse. However, they are complex in structure and not mobile in the trench, thereby being inconvenient for use in a construction site especially in a pipe construction work.

U.S. Pat. No. 5,306,103 to Spencer disclosed a wheeled carriage assembly for trench shield having protective panels (18) hung on an axle members (30) of a plurality of wheels (52) which are rolling on a ground surface (22) adjacent the trench. Such a wheeled carriage assembly may suspend and support a trench shield for advancement along an excavated trench such as for laying a pipe (16) in the trench.

However, such a prior art (U.S. Pat. No. 5,306,103) has the following drawbacks:

1. The total weight of the trench shield is loaded and focused on the wheels (52) which are supported on the ground surface very near the trench excavation (14). The ground surface soil between the wheel (52) and the trench excavation (14) is so weak and may be vulnerably collapsed especially when subjected to the heavy pressure caused by the trench shield.
2. For adjusting the spacing of the two panels (18) along the axle (30) of the wheels, the heavy weight of the shield as suspended on the axle (30) will cause friction between the brackets (40) and the axle (30), thereby increasing the adjustment difficulty.
3. The ground surface adjacent the trench excavation may be piled or placed with excavated materials, soil or stones to cause corrugated or uneven ground surface, thereby obstructing the rolling of the wheels and influencing the forward movement of the trench shield.

The present inventors have found the drawbacks of the conventional trench shields and invented the present trench shield easily constructed and conveniently moved in a trench excavation.

SUMMARY OF THE INVENTION

The object of the present invention is to provide a trench shield including: a pair of shielding wheels rotatably mounted on a pair of retaining plates; a plurality of brace members passing through the two retaining plates for retaining the two shielding wheels, each shielding wheel formed as a protective circular panel for shielding a side wall of a trench excavation for preventing collapse of the trench walls; and two control devices each provided for locking or unlocking each shielding wheel on each retaining plate; whereby upon unlocking of the wheels from the retaining plates and upon rolling of the wheels in the trench, the trench shield will be forwardly moved conveniently and smoothly.

DETAILED DESCRIPTION

Figure 1:
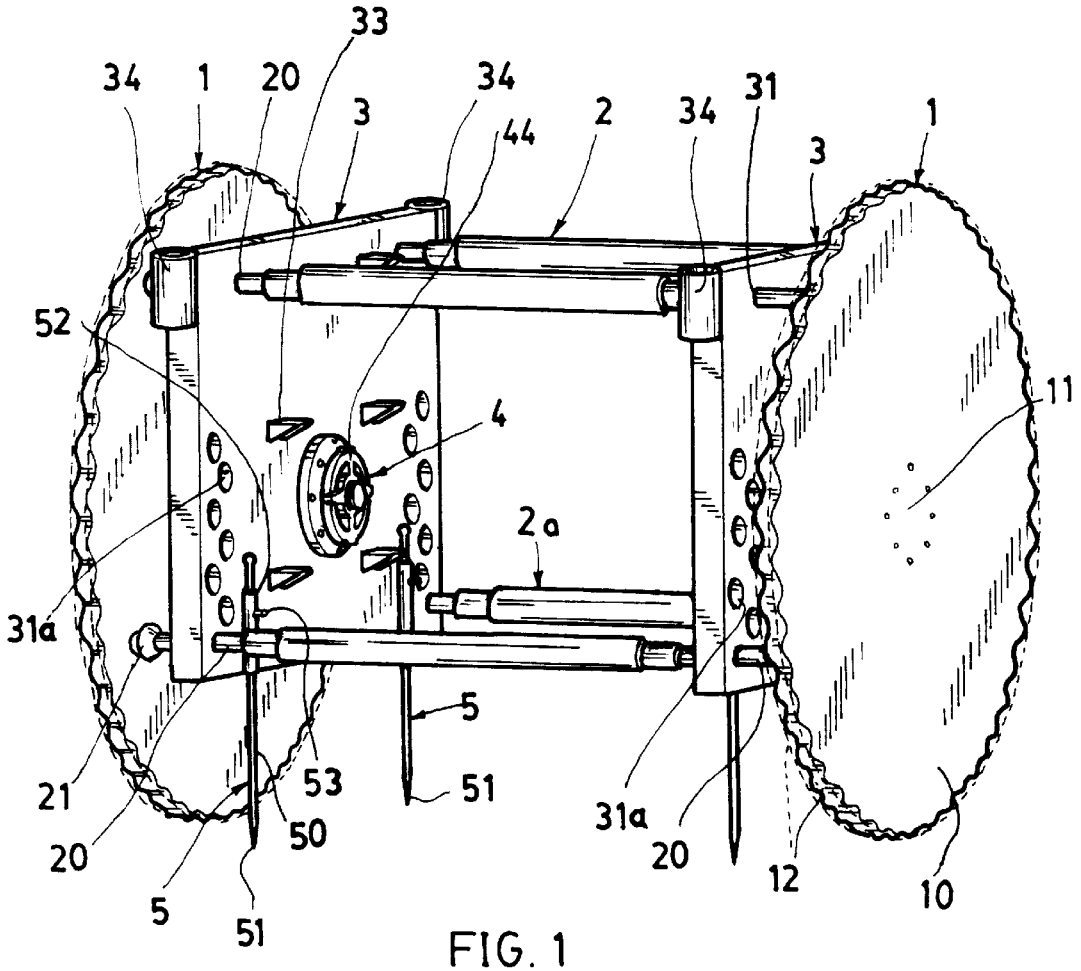
FIG. 1 is a perspective view of the present invention.

As shown in FIGS. 1~5, a trench shield of the present invention comprises: a pair of shielding wheels 1 transversely extended by a plurality of brace members 2, 2*a* spaced between the two wheels 1 for supporting two side walls W of a trench excavation T for laying a pipe P, P1 in the trench excavation T, a pair of retaining plates 3 each plate 3 contiguous to each wheel 1 and each plate 3 having the brace members 2, 2*a* passing through said plate 3 for retaining each wheel 1, a pair of control means 4 each provided on each retaining plate 3 for locking or unlocking each wheel 1 on the retaining plate 3, and a plurality of braking means 5 mounted on the retaining plates 3 and operatively inserted into the soil in the trench excavation T for preventing slipping or movement of the trench shield when proceeding the work such as laying the pipe in the trench excavation T.

Each shielding wheel 1 may be made of materials having good mechanical strength durable for shielding side walls of a trench, for instance, fiber-glass reinforced plastic (FRP), steel, aluminum alloy, composites or engineering plastics, not limited in the present invention.

The shielding wheel 1 may be a circular panel having a periphery formed with gear teeth or corrugated perimeter to be well rotated in a wet soft surface in the trench excavation without slipping. The periphery 12 may also be formed as a circular perimeter as shown in dotted line of FIG. 1.

Each brace member 2, 2*a* includes a hydraulic cylinder for pressurizing a pair of telescopic rods 20 disposed on opposite ends of the hydraulic cylinder for urging each telescopic rod 20 against the shielding wheel 1 by means of a roller or an anti-thrusting bearing 21 provided in an outer end of each telescopic rod 20, allowing a rotation of the wheel 1 for a forward movement of the trench shield within the trench excavation.

Figure 4:
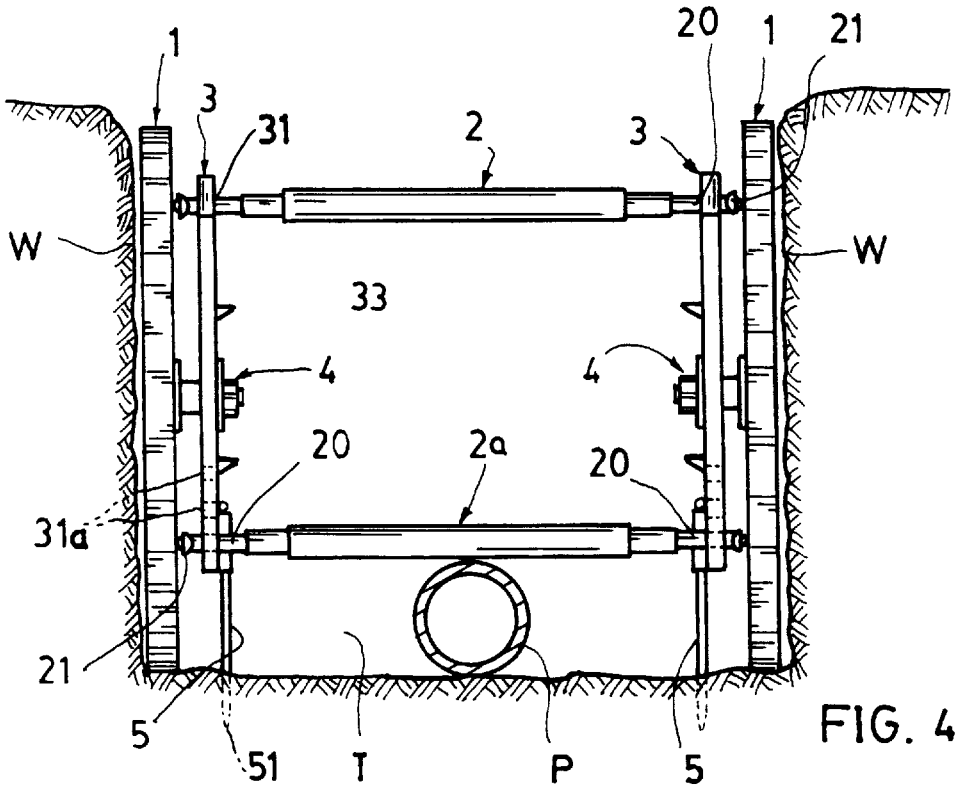
FIG. 4 is an illustration showing a shielding protection in a trench excavation as effected by the present invention.

The hydraulic cylinder may be filled with a hydraulic oil therein for maintaining the liquid pressure in the hydraulic cylinder at a fixed or constant pressure for urging the two telescopic rods 20 for supporting the two shielding wheels 1 for shielding the side walls W of the trench T as shown in FIG. 4.

Each brace member 2, 2*a* may also be a screw jack adjustably retained between the two shielding wheels 1 for retaining the two shielding wheels for protecting the walls of the trench.

Figure 5:
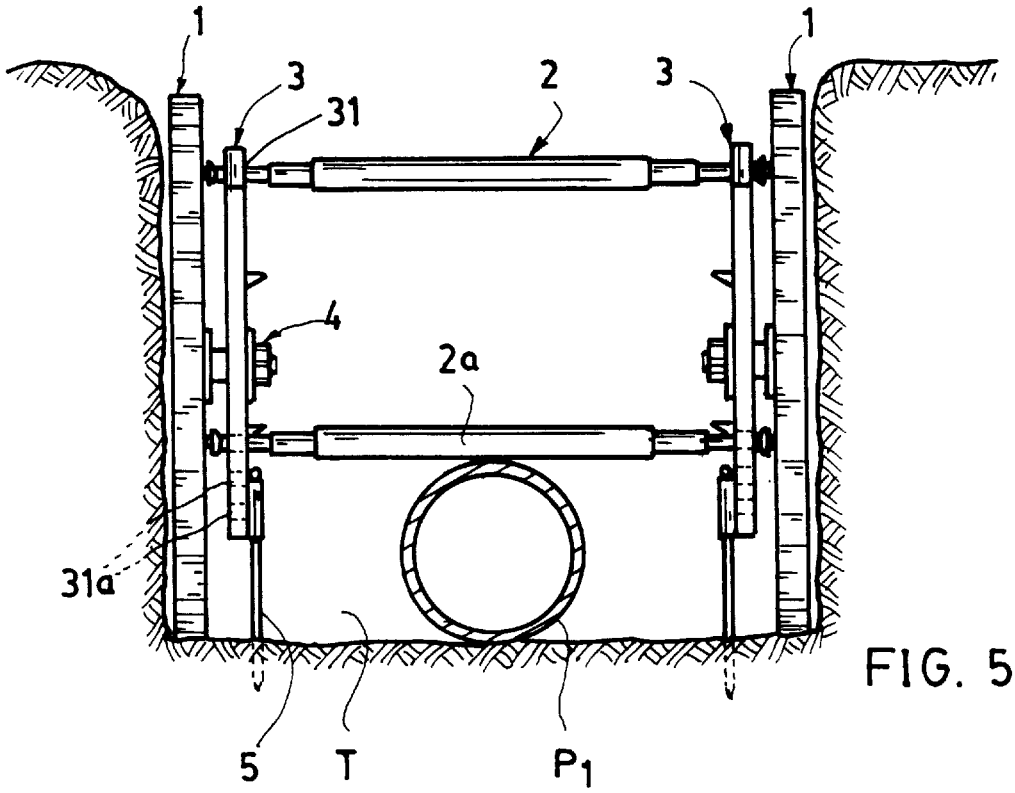
FIG. 5 is an illustration showing the using of the present invention for laying a pipe having a diameter larger than that of FIG. 4.

The upper brace member 2 is provided to support the upper portion of each wheel by passing through the upper brace hole 31 formed through an upper portion of the retaining plate 3; while the lower brace member 2*a* is provided to support the lower portion of the wheel 1 by passing through the lower brace hole 31*a* formed in the lower portion of the retaining plate 3. On the lower portion of the retaining plate 3, a plurality of lower brace holes 31*a* are formed therethrough for adjustably holding the lower brace member 2*a* through the lower brace hole 31*a*, with respect to the height (diameter) of the pipe P, P1 as laid in the trench T. As shown in FIG. 4, the pipe P has a small diameter so that the lower brace member 2*a* may be positioned at a lower height; while the pipe P1 as shown in FIG. 5 has a larger diameter so that the lower brace member 2*a* should then be positioned at a higher height for a convenient construction work when laying the pipe in the trench.

The brace member 2, 2*a* may be formed with a telescopic mechanism therein for adjusting length corresponding to a spacing between the two wheels 1 for stably retaining each brace member between the opposite wheels 1.

The retaining plate 3 is formed with a plurality of step members 33 on the plate 3 to serve as a ladder to allow the worker to climb upwardly or downwardly by treading the step members 33.

Each control means 4 includes: an axle 41 secured with a central portion 11 of each shielding wheel 1 and rotatably held in a bushing 42 fixed in a central hole 32 of the retaining plate 3, and a hand-wheel nut 44 engageable with the axle 41 having a washer 43 packed between the nut 44, the bushing 42 and the retaining plate 3.

The axle 41 of the control means 4 includes: a flange 411 secured with a central portion 11 of the shielding wheel 1 by screws or bolts 412, and a male-threaded portion 413 protruding inwardly from the flange 411 to be engageable with the hand-wheel nut 44 having female threads formed therein; with the axle 41 rotatably mounted in a central through hole 420 formed in the bushing 42 having two bearings 421, 422 disposed in opposite ends of the bushing 42 for rotatably securing the axle 41 in the bushing 42.

The washer 43 is secured on the retaining plate 3 by screws or bolts 431, having a central hole formed in the washer 43 for passing the axle 41 therethrough.

The nut 44 may also be modified to have a larger hand wheel or handle radially secured to the nut for an easier rotation of the nut.

Figure 3:
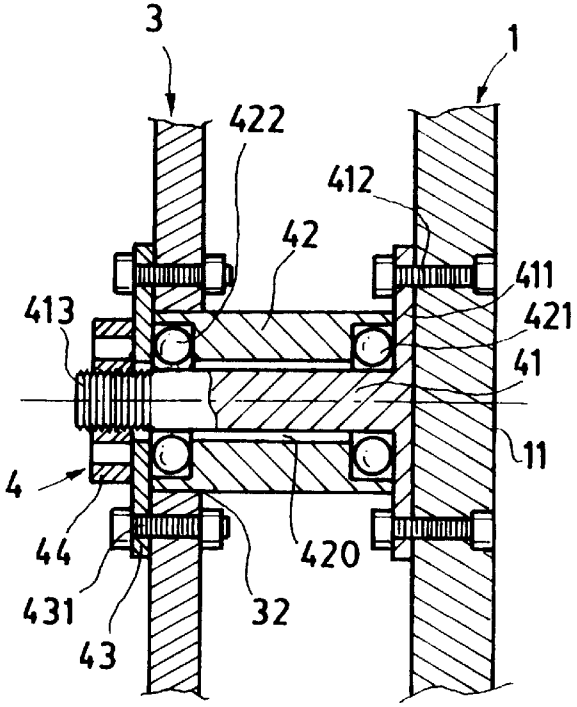
FIG. 3 is a partial sectional drawing of the wheel and the retaining plate of the present invention.
Figure 2:
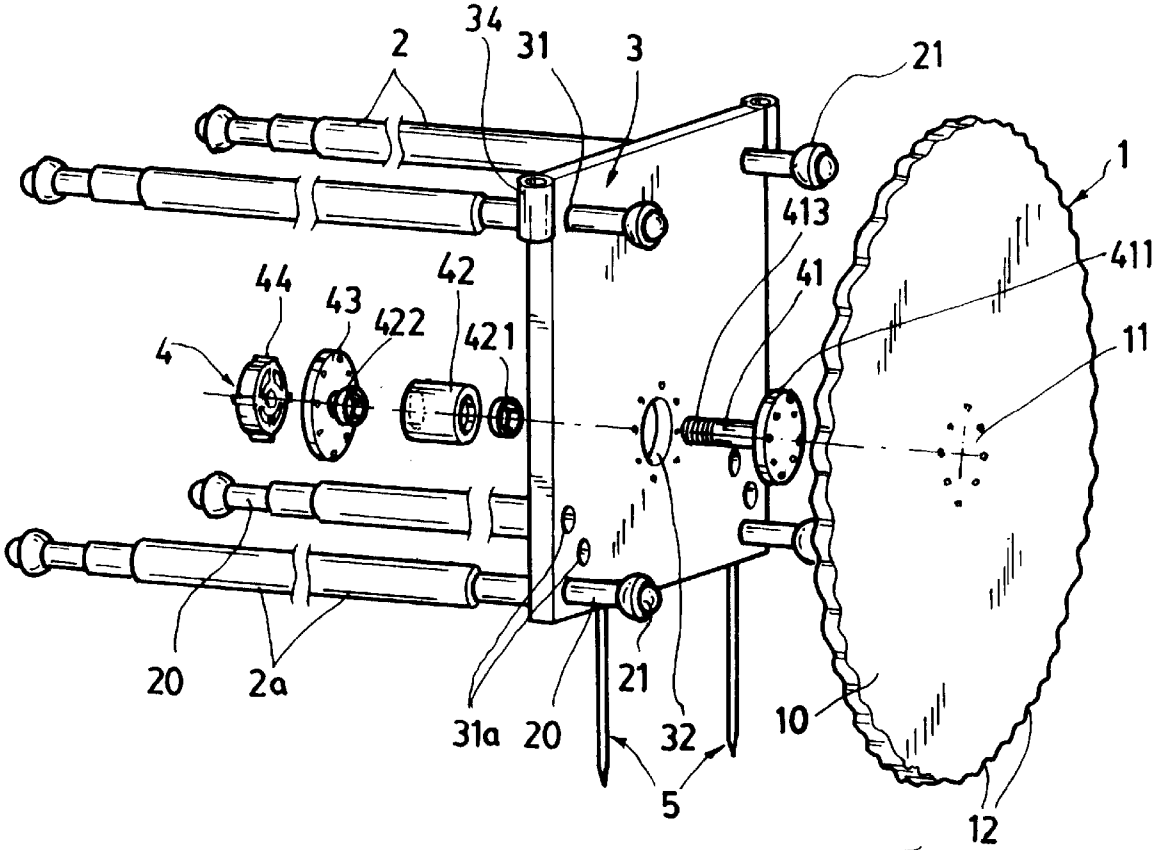
FIG. 2 is an exploded view showing partial elements of the present invention.

Upon tightening or fastening of the nut 4 with the male-threaded portion 413 of the axle 41 as shown in FIG. 3, the wheel 1 will be steadily locked on the retaining plate 3 for proceeding the piping engineering within the trench T. For moving the shield forwardly when continuing the piping engineering, the nut 4 may be loosened from the axle 41 to allow a free rotation of the wheel 1 about the bushing 42 and the retaining plate 3 by rolling the wheel 1 on the trench bottom surface.

For larger pipe P1 as shown in FIG. 5, the lower brace members 2*a* may be adjusted at a higher position on the retaining plates 3 to free pass the pipe P1 under the brace members 2*a*, without obstructing the work in the trench T. During movement of the shield, each wheel 1 may keep an aperture between the wheel 1 and the side wall W to prevent from retarding by the wall W.

The width or spacing between the two wheels 1 may be well adjusted before placing the shield into the trench.

When rolling to the desired location, the braking means 5 may be actuated to brake or stop the shield in the trench. The braking means 5 includes: a braking pin or nail 50 having a sharp point 51 inserted into the soil in the trench, a sleeve 52 fixed on the retaining plate 3 for telescopically engaging the pin 50 therein, and an adjusting knob 53 formed on the sleeve 52 for fastening or locking the pin 50 when the sharp point 51 is inserted into a desired depth under the trench bottom. Other braking means or systems may be further modified and not limited in this invention.

For increasing the shielding height of the present invention, modifications can be made as hereinafter described, or otherwise made by those skilled in the art.

Figure 6:
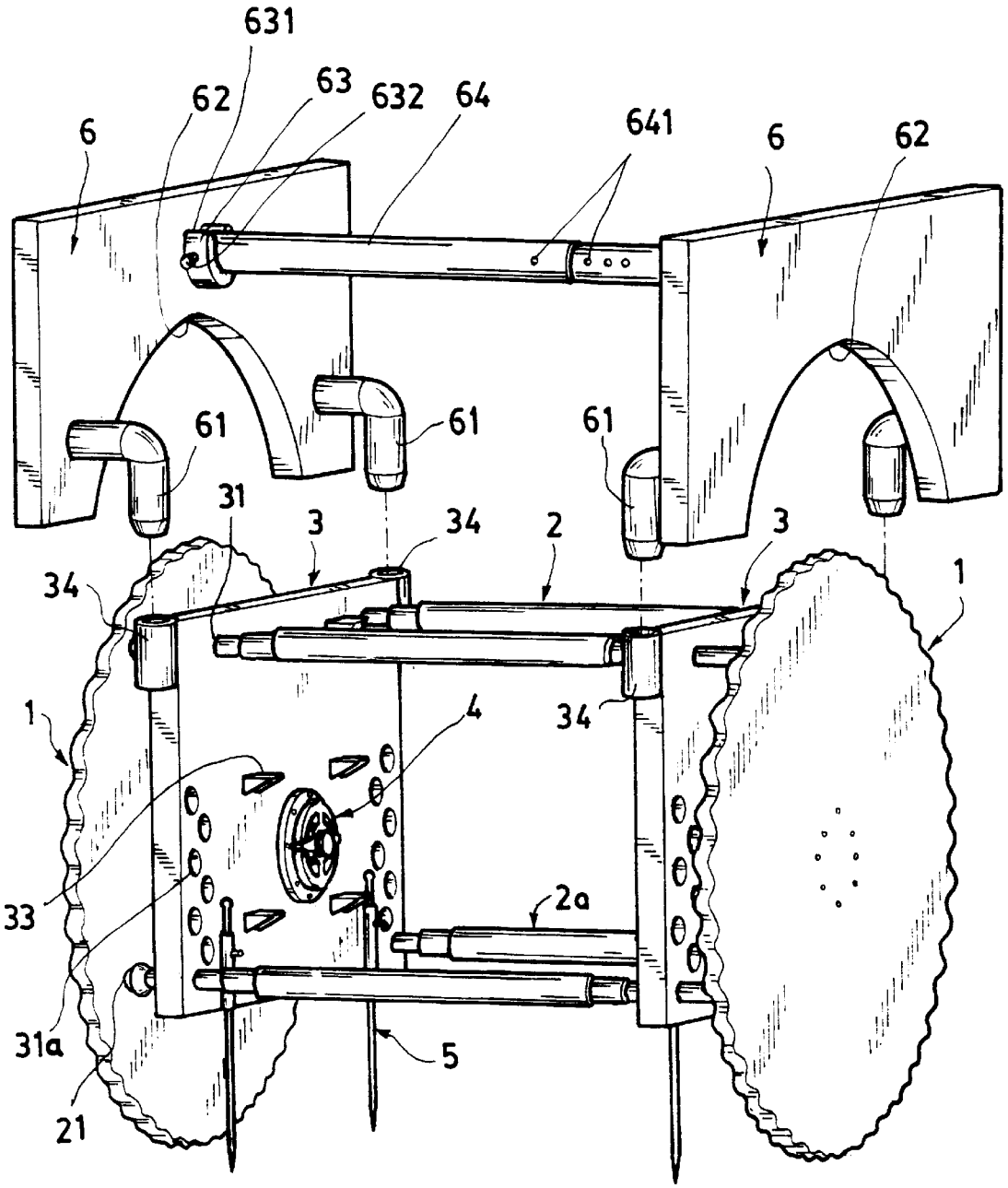
FIG. 6 shows another preferred embodiment of the present invention.

As shown in FIG. 6, each retaining plate 3 is formed with a plurality of socket members 34 on an upper portion of the plate 1 for engaging a plurality of tenons 61 formed on a lower portion of an auxiliary panel 6 for superimposing the auxiliary panel 6 above the wheel 1 for increasing the shielding height of the shield of the present invention.

Each auxiliary panel 6 includes: two tenons 61 formed on opposite lower portions of the panel 6 to be engaged with the two socket members 34 formed on opposite upper portions of the retaining plate, an arcuate recess 62 concavely recessed in a central bottom portion of the panel 6 to be projectively engageable with the wheel 1 without obstructing the rotation of the wheel 1, and at least a brace member 64 transversely retained between one auxiliary panel 6 with another corresponding auxiliary panel 6 with two opposite auxiliary panels 6 respectively engaged on the two retaining plates 3 for increasing the shielding height of the trench shield to be adapted for a deeper trench T.

The brace member 64 has its opposite end portions held on two brackets 63 respectively fixed on the retaining plates 6. Each bracket 63 may be formed with a cavity 631 for receiving the end portion of the brace member 64 and fastened by a screw or bolt 632. The brace member 64 may be provided with telescopic adjusting means including perforations 641 drilled in the telescopic tubes of the brace member 64 which may be fastened or locked by a pin or the like, not limited in the present invention.

Figure 7:
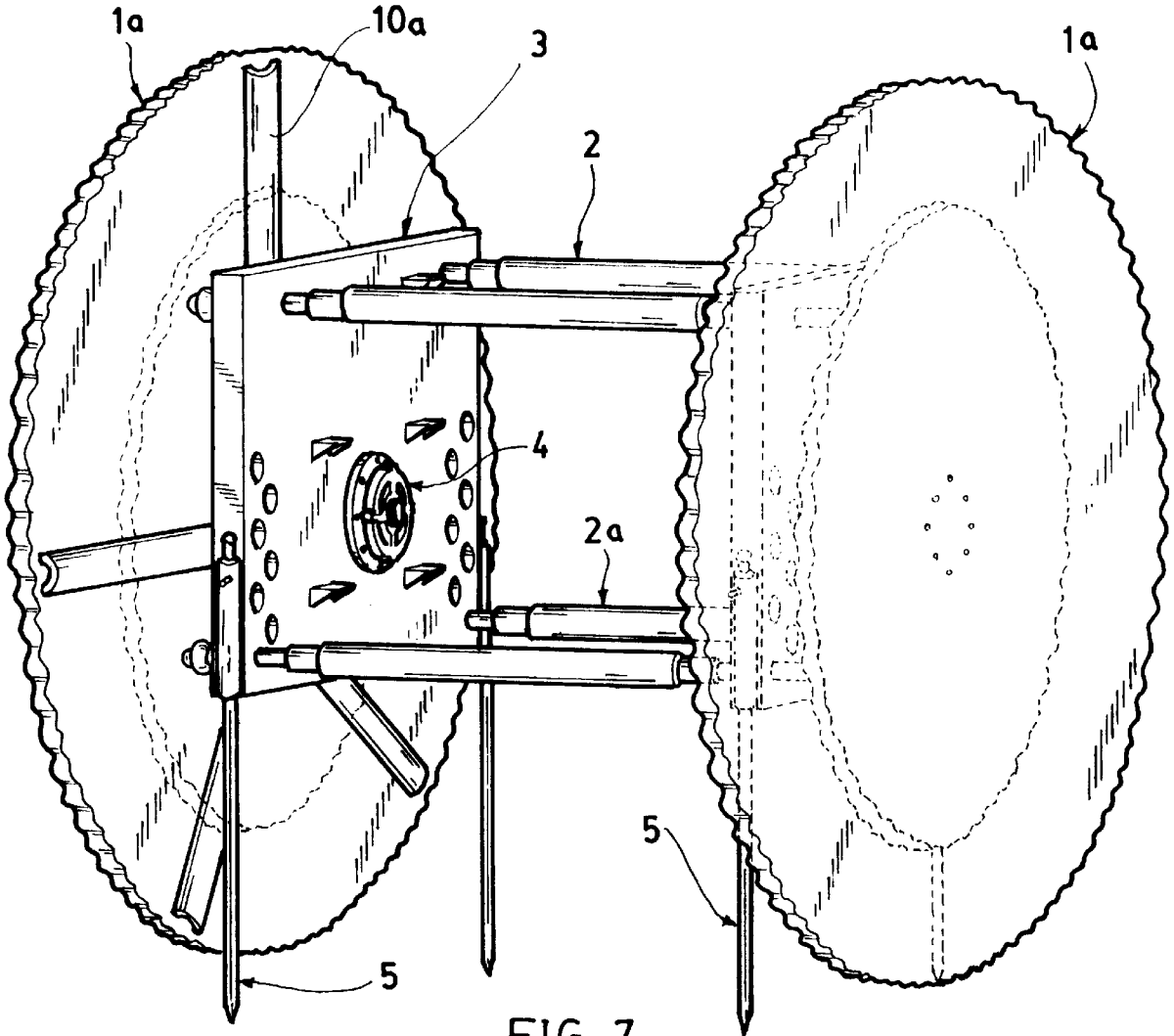
FIG. 7 shows still another preferred embodiment of the present invention.

As shown in FIG. 7, the wheel 1 is modified to be a large-diameter wheel la radially reinforced with reinforcing ribs 10*a* on the wheel la for increasing the diameter and height of the wheel for increasing the shielding height of the shield. The braking means 5 may be secured to a lower portion of the retaining plate 3 for braking the wheels 1*a* on the trench bottom for working use.

The wheel 1 as shown in FIG. 1 may also be provided with reinforcing ribs on the wheel for reinforcing the strength of the wheel. If for use in a trench not slippery, the wheel 1 may be formed as circular perimeter as dotted line shown in FIG. 1, rather than a corrugated teeth periphery.

Other modifications may be made without departing from the spirit and scope of this invention. The wheel 1, 1*a* may be integrally formed with a solid disk or sheet generally circular shaped.

The present invention is superior to a conventional trench shield with the following advantages:

1. Each wheel 1 rotatably secured on the retaining plate 3 plays double roles, namely serving as a shielding panel for protecting side walls of a trench and provided for a "cart" wheel for forwardly rolling the wheel on a trench bottom for a convenient movement of the trench shield in a trench excavation.
2. The wheel 1 is directly served as a protective panel for shielding the walls of a trench, thereby saving the complex assembly work and cost for stacking a plurality of beams, sheet pilings for forming a panel of a conventional trench shield.
3. For locking or unlocking operation, just rotating the nut 44 of the control means 4, the wheel 1 will be easily manipulated for stopping or rolling operation. Each adjustment for changing the width or spacing between the two opposite wheels 1 can be well done in this invention.
4. The weight of the shield is completely loaded on the trench bottom, not on the ground surface adjacent the trench excavation, thereby preventing collapse on the ground surface near the trench excavation.
5. Even facing uneven bottom surface in the trench T, the problem can be easily solved since the trench bottom surface can be easily flattened by the workers just working in situ within the trench, thereby causing no influence for a smooth forward movement within the trench.

I claim:

1. A trench shield comprising:

a pair of shielding wheels respectively rotatably mounted on a pair of retaining plates for rolling on a trench bottom in a trench excavation, each said shielding wheel served as a protective panel for shielding a side wall of the trench excavation;

a plurality of brace members each said brace member passing through said two retaining plates and having opposite end portions of each said brace member retaining said two wheels against two side walls of the trench excavation; and two control means each said control means mounted on each said retaining plate for rotatably securing each said wheel on said retaining plate; said control means operatively locking said wheel for stopping the trench shield within the trench excavation for working therein, and said control means operatively unlocking said wheel to allow said wheel rolling on the trench bottom for moving the trench shield in the trench excavation.

2. A trench shield according to claim 1, wherein each said shielding wheel includes a periphery formed with corrugated teeth circumferentially on the periphery.

3. A trench shield according to claim 1, wherein said brace member is telescopically adjustable to be retained between the two shielding wheels.

4. A trench shield according to claim 1, wherein each said retaining plate is formed with a plurality of brace holes in a lower portion of said retaining plate for selectively passing the brace member therethrough for adjusting a height of the brace member without obstructing an engineering construction done in the trench excavation.

5. A trench shield according to claim 1, wherein each said brace member includes a rod formed on an end portion of said brace member, having an anti-thrusting bearing mounted on an outer end of said rod for rotatably retaining said shielding wheel and allowing a free rotation of said wheel against the anti-thrusting bearing on the rod of the brace member.

6. A trench shield according to claim 1, wherein said retaining plate is formed with plurality of step members on said plate for climbing use.

7. A trench shield according to claim 1, wherein said wheel is reinforced with reinforcing ribs on said wheel for increasing the mechanical strength thereof.

8. A trench shield according to claim 1, wherein each said control means includes an axle having an outer end portion secured with a central portion of said wheel and having an inner end portion of said axle formed as a male-threaded portion, a bushing rotatably disposed about said axle and secured to said retaining plate, a nut engageable with said male-threaded portion of said axle and fastened on said retaining plate and said bushing as packed by a washer between said nut and said retaining plate; whereby upon loosening of said nut from said male-threaded portion of said nut, said wheel is free rotated in said bushing and said retaining plate for rolling said wheel in the trench excavation; and upon fastening of said nut on said retaining plate, said wheel will be locked.

9. A trench shield according to claim 8, wherein said axle is formed with a flange for securing the wheel on said flange, said axle rotatably mounted in said bushing with two bearings provided in opposite ends of said bushing.

10. A trench shield according to claim 8, wherein said nut is radially formed with a means selected from a hand wheel and a handle for an easy rotation of the nut.

11. A trench shield according to claim 1, wherein said retaining plate includes at least a braking means secured on said plate for braking the shield in a trench bottom.

12. A trench shield according to claim 11, wherein said braking means includes: a braking pin slidably held in a sleeve fixed on said retaining plate, and an adjusting knob for fastening said pin in said sleeve when a desired depth of the pin inserted into the trench bottom is obtained.

13. A trench shield according to claim 1, wherein each said retaining plate is further superimposed with an auxiliary panel thereon for increasing a shielding height.

14. A trench shield according to claim 13, wherein said auxiliary panel includes a plurality of tenons formed on a lower portion of the panel to be engageable with a plurality of socket members formed on an upper portion of said retaining plate for superimposing said auxiliary panel on said retaining plate, an arcuate recess concavely recessed in a central bottom portion of said auxiliary panel to be projectively engageable with the wheel to position said auxiliary panel above said wheel for increasing a shielding height, and at least a brace member retained between two said auxiliary panels respectively superimposed on said two wheels.

15. A trench shield according to claim 14, wherein said brace member is telescopically adjustable to be retained between said two auxiliary panels and is held on two brackets formed on said two auxiliary panels.

16. A trench shield according to claim 1, wherein said shielding wheel is integrally formed as a panel generally circular shaped.

* * * * *